US006502338B1

(12) United States Patent
Marshall

(10) Patent No.: US 6,502,338 B1
(45) Date of Patent: Jan. 7, 2003

(54) PIEZOELECTRIC ROTATING POINT-OF-PURCHASE DISPLAY

(76) Inventor: Roger S. Marshall, 4922 Comish Heights, Syracuse, NY (US) 13215

( * ) Notice: Subject to any disclaimer, the term of this patent is extended or adjusted under 35 U.S.C. 154(b) by 0 days.

(21) Appl. No.: 09/366,515

(22) Filed: Aug. 3, 1999

Related U.S. Application Data

(63) Continuation of application No. 08/823,476, filed on Mar. 25, 1997, now Pat. No. 6,209,242.

(60) Provisional application No. 60/095,339, filed on Apr. 4, 1998, and provisional application No. 60/014,163, filed on Mar. 27, 1996.

(51) Int. Cl.[7] ..... G09F 19/02

(52) U.S. Cl. ..... 40/430; 40/456; 40/465

(58) Field of Search ..... 40/430, 435, 456, 40/474; 310/328, 317, 323.02

(56) References Cited

U.S. PATENT DOCUMENTS 1,945,072 A 1/1934 Quigley
2,798,324 A * 7/1957 Berger et al. ..... 40/430
4,755,705 A * 7/1988 Holum ..... 310/328
4,764,850 A 8/1988 Albanese
4,970,810 A 11/1990 Liou
4,998,364 A 3/1991 Sengstalen
5,345,153 A 9/1994 Vaught
5,367,808 A 11/1994 Liebman

* cited by examiner

*Primary Examiner*—Cassandra H. Davis
(74) *Attorney, Agent, or Firm*—Stephen B. Salai, Esq.; Brian B. Shaw, Esq.; Harter, Secrest & Emery LLP

(57) ABSTRACT

A motorized display using piezoelectricity to impart motion to point-of-purchase displays or other items is disclosed. A quartz movement, otherwise used for rotary movement of anniversary clocks, is preferably used to rotate the display. According to preferred embodiments, the motor has a drive train including a drive shaft and a battery as a power source. The drive shaft rotates when the motor is powered, a holder for a sign or merchandise item is positioned on the end of the drive shaft exterior to the motor housing and may be removable from the drive shaft. The drive shaft may be positioned vertically, horizontally or diagonally depending on the type of display being used. The rotation of the drive shaft may be either continuous one way or a 360 degree two-way revolution.

13 Claims, 18 Drawing Sheets

PIEZOELECTRIC ROTATING POINT-OF-PURCHASE DISPLAY

This application claims priority of prior U.S. provisional application Ser. No. 60/095,339, filed Aug. 4, 1998, and prior copending U.S. application is a continuation of Ser. No. 08/823,476, filed Mar. 25, 1997, which claims the benefit of provisional application Ser. No. 60/014,163 field Mar. 27, 1996, now U.S. Pat. No. 6,209,242, the entire disclosures of which are incorporated herein by reference.

FIELD OF THE INVENTION

The present invention relates generally to a motorized point-of-purchase (POP) display for corrugated displays, figurine displays, display poles, ceiling fixtures, shelf fixtures, brochure holders and mobile displays to display items that would benefit from movement in advertising. More particularly, this invention relates to a display using piezoelectricity supplied by a quartz motor powered by a small battery to rotate a drive shaft which supports an item holder or the item itself.

BACKGROUND OF THE INVENTION

POP displays are commonly used in department stores, supermarket stores, convenience stores or just about any retail store displaying goods for sale to enhance the products being sold. The store owner and manufacturer of the product benefits from having a POP display done in an attractive fashion to catch the eyes of potential customers. POP displays are typically displayed stationary with no motion.

In the past, objects which rotate on a stand have been devised for various reasons. U.S. Pat. No. 1,945,072 to Quigley discloses a display apparatus for displaying and rotating packaged goods, which are exteriorly decorated with advertising. The apparatus requires an electrical outlet for operation, a set of mirrors, and a flashlight apparatus. U.S. Pat. No. 4,764,850 to Albanese discloses a solar-powered display device for displaying a multi-faceted crystal. U.S. Pat. No. 4,970,810 to Liou discloses an electronic flower set with intermittent movement. The apparatus must be turned on and off and movement of the flower requires the receipt of a sound signal. U.S. Pat. No. 4,998,364 to Sengstaken discloses a miniature airplane and curved banner for spinning about the top of a housing. U.S. Pat. No. 5,367,808 to Liebman et al discloses a sign turner with a low power consumption controller. The devices disclosed in these patents are either too large, complex, costly, and/or unattractive for use as a point of purchase display. Furthermore, none of the disclosed devices take advantage of piezoelectric motors, which eliminates many of the undesirable qualities of the prior art displays.

Thus, there is a need for an improved POP display, which can better capture the attention of potential customers. There is further a need for a rotating display capable of displaying motion in or on a POP display. There is further a need for a POP display with motion which can be manufactured and utilized at a low cost in order to employ a multiplicity of such displays in various types of POP displays. There is further a need for a rotating display, which is small enough to be adapted for use in a POP display. There is further a need for a rotating display which takes advantage of piezoelectricity and which can be aesthetically pleasing in POP displays. There is further a need for a rotating POP display, which can accommodate various display items. There is further a need for a rotating display, which can rotate a variety of POP items economically and efficiently.

SUMMARY OF THE INVENTION

Therefore, it is a primary object of this invention to improve the quality and attractiveness of POP displays by imparting motion to the POP display or a portion thereof in which a sign or merchandise item is displayed.

It is further an object of this invention to provide a rotating motion to POP displays at a low cost to the store owner or manufacturer of the product being sold.

It is further an object of this invention to provide a motion to POP displays motorized by piezoelectricity.

It is further an object of this invention to provide a rotating display, which may incorporate a photosensitive switch for permitting operation of the rotating display in response to an ambient light. A small hole may also be provided on the side of the motor housing to allow the mounting of a photocell. A photocell may be attached to a 3 piece sandwich shaped like a penny. The outer 2 pieces are conductive with the center piece being non conductive. This "penny" is placed between one end of the battery terminal and one end of the battery. As light is detected the display turns. In addition, and advantageously, when the lights go out in the room, such as at closing, the display stops rotating.

It is further an object of this invention to provide a piezoelectric rotating display for displaying items of merchandise such as a grocery item, a sporting good item, a toy, a jewelry item, and replicas thereof.

The foregoing objectives of the present invention are accomplished by a motorized POP display used in corrugated displays, figurine displays, display poles, ceiling fixtures, shelf fixtures, brochure holders and mobile displays or other items that would benefit from movement in trade. Piezoelectricity is preferably used to create the movement. When certain crystals, such as quartz, are compressed in certain directions, an electric polarization (and a corresponding voltage called piezoelectricity) is induced due to the displacement of charged atoms along the same axis. The piezoelectric effect is used in many applications around the world such as the quartz oscillator for timepieces. In a quartz oscillator, the extremely regular mechanical vibrations of a quartz crystal control corresponding electrical oscillations in a coupled electronic circuit, in a way analogous to the regulation of a mechanical clock by the oscillation of its pendulum.

The main benefit of piezoelectricity is the very low power requirement needed to create movement. Small batteries such as one "AA" battery can power a movement 24 hours a day for over a year depending on the weight of the display being turned. In one embodiment, the design may incorporate a photocell to detect light, which allows the movement to shut-off if no light is detected in the environment. For example, if the motorized POP display was in a place of business where the hours of operation were 12 hours a day (lights in the room turned on) and 12 hours a day closed (lights in the room turned off) then the life of the battery could effectively double.

Another benefit of using piezoelectricity is low cost. Using inexpensive quartz movements allows the cost structure of the motorized point-of-purchase displays to be very competitive against other displays that use movement. The main demand of using quartz as the material to create piezoelectricity is keeping time accurately and inexpensively because quartz has a property of generating extremely regular mechanical vibrations. This demand has allowed the cost structure of quartz movements to drop. Motorized POP displays may not always require the accuracy of movement that timepieces require but the present invention may effectively and economically use quartz movements because of the low cost structure. It is possible to substitute quartz for another crystal or ceramic material once the market for motorized POP displays becomes big enough. In addition to the low cost structure, the accuracy of movement created by the quartz oscillators may be taken advantage of in motorized point-of-purchase displays by synchronizing displays which are placed in the same vicinity as one another for creating a dramatic effect.

In a preferred embodiment, the display starts with a quartz movement that requires a battery such as a "AA" size. If the display is intended to rotate heavier items, a larger quartz motor powered by, for example, a "C" size battery may be required.

This invention provides a merchandise display comprising a rotating display device, wherein the rotating display device comprises a piezoelectric motor, a drive train connected to the piezoelectric motor, the drive train extending to the exterior of a housing of the motor, and a holder connected to the drive train exterior to the housing, the holder adapted to securely hold a sign or merchandise item. The holder may be removably attached to the drive train. The merchandise display may include multiple items of merchandise.

According to certain embodiments, the piezoelectric motor is adhered to a rear side of a section of the merchandise display, for example, with an adhesive, the drive train extending through an aperture in the merchandise display section, and the holder is attached to the drive train and located on an opposed, front side of said merchandise display section. The holder may include a shaft with a central aperture that forms a sleeve into which a drive shaft of the motor is received.

According to other embodiments, the motor may be attached to an edge of a shelf on which merchandise is displayed. Alternately, the motor may be mounted to a ceiling, and the holder is connected to the drive train in a manner that it is suspended from the motor.

The holder may be adapted to securely hold a sign with textual information advertising merchandise , or with a hologram. Alternately, the holder may be adapted to securely hold a merchandise item selected from a grocery item, a sporting good item, a toy, and replicas thereof.

The quartz movement may optionally be covered with an aesthetically pleasing cover, in which case a hole is provided through the center of the cover to allow the drive shaft to protrude through the top. Glue may then be applied on top corners of the motor to secure the movement to the cover. Alternatively, the cover may be made by injection molded plastic. The molded covers can be provided with tabs, which snap onto indents provided in existing quartz motors, which reduces labor costs.

This invention allows for different display attachments to be used on the POP display. For example, a piezoelectric motor can be used horizontally in a corrugated cardboard display by putting a small hole in the corrugated cardboard display. By attaching the piezoelectric motor to the rear of a corrugated cardboard display and placing the piezoelectric motor's drive shaft horizontally though the hole made in the corrugated cardboard display, the piezoelectric motor is secured with adhesive mounts. A lightweight display is then attached to the drive shaft of the piezoelectric motor. The lightweight display turns with respect to the stationary corrugated display as the background. The lightweight display itself may be fabricated from corrugated cardboard, plastic, printed hologram, etc. The rotating display is attached to the piezoelectric motor's shaft with a small snap cap. If the user would like to use a different display attachment for the rotating display, he or she may simply pull the rotating display off with slight outward pressure by hand. Then the user can, for example, snap on a different rotating display with different printed information, different shaped object or different printed hologram, etc. The rotating displays may be attached to the drive shaft of the piezoelectric motor in a number of other ways, such as by screw threads, gravity, snap-fit, or friction fit connections.

Different types of movement may be imparted to different types of POP displays, as is deemed appropriate. For example, a continuous one direction movement is ideally used for the motion of mimicking the movement of tires in a car display or a golf ball in flight. Another type of motion is rotating 360 degrees then reversing direction for 360 degrees, especially useful for holographic prints.

In an alternate embodiment, the piezoelectric motor can be attached to standard metal price rails. Standard metal price rails are used, for example, by the supermarket industry to display the price of goods for sale, typically attached to the shelf were the goods are being sold. The price rail is increasingly being used to display advertisement along with the price. The piezoelectric display is used to impart motion to the advertisement display right at the product shelf. The piezoelectric display may snap-fit into a plastic mount, with this plastic mount snap-fit into the standard metal price rail much the same way stationary displays are mounted to standard metal price rails.

In another alternate embodiment, a golf ball display employs the piezoelectric motor to turn a golf ball with a picture of a golf club in the background to simulate the motion of the golf ball in flight. This display may have a green cover for the piezoelectric motor with a tee attached to the drive shaft and a golf ball mounted on the tee. A cardboard ad of a golf club may be attached to the base of the green cover to be used as the backdrop for the golf ball. This display could be used in golf pro shops, sporting goods stores, department stores, etc.

In another alternate embodiment, a beverage display may rotate, for example, empty soda cans or soda can replicas. The piezoelectric displays may be mounted to the soda displays were the soda is being sold. The empty soda can may be attached to a small turntable via glue or other adhesives. The bottom of the turntable may have a sleeve that attaches over the drive shaft of the piezoelectric motor.

In another alternate embodiment, a greeting card display rotates new greeting cards or rotates signs announcing a new holiday such as Mother's Day, Valentines Day, etc. The piezoelectric displays are mounted to the greeting card display where greeting cards are being sold.

In another alternate embodiment, a brochure holder display has a piezoelectric motor mounted on the back thereof. The piezoelectric display turns one of the brochures or a display sign inviting the consumer to take a brochure.

In another alternate embodiment, a ceiling display has the piezoelectric motor mounted upside down to the ceiling. A lightweight sign is attached to the drive shaft and turns an advertisement.

In another alternate embodiment, a figurine display has the piezoelectric motor mounted on top of a store display selling small figurines. The piezoelectric motor may have a turntable on which the figurine is placed. The piezoelectric display could be part of the figurine product, where the piezoelectric display is included in the package of the figurine for sale.

These and other objects and features of the present invention will be apparent from the following description taken in conjunction with the accompanying drawings, in which like reference characters designate the same or similar parts throughout the figures thereof.

DETAILED DESCRIPTION OF THE INVENTION

Figure 1B:
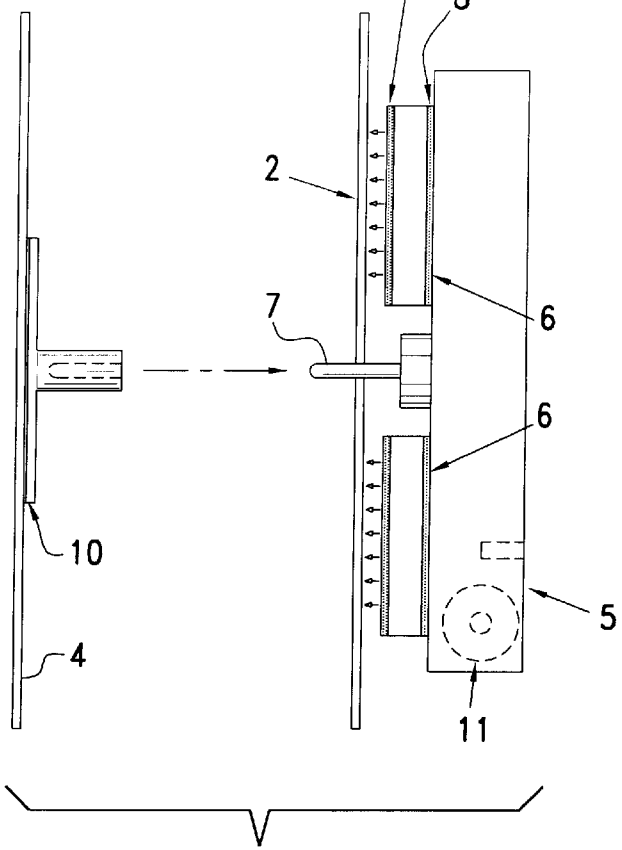
FIG. 1B shows a side view of the rotating display of FIG. 1A.
Figure 1A:
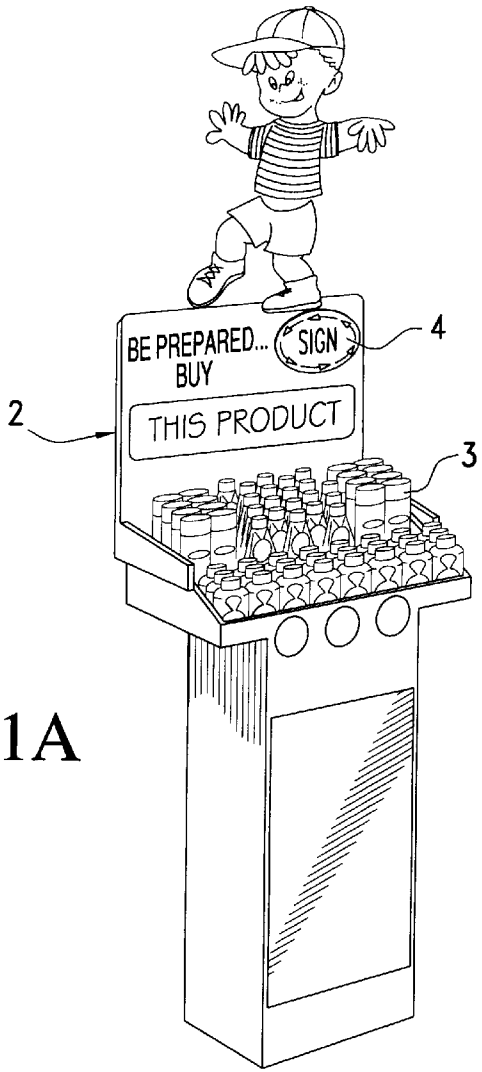
FIG. 1A shows a front perspective view of an assembled POP corrugated cardboard display including a rotating display.
Figure 1C:
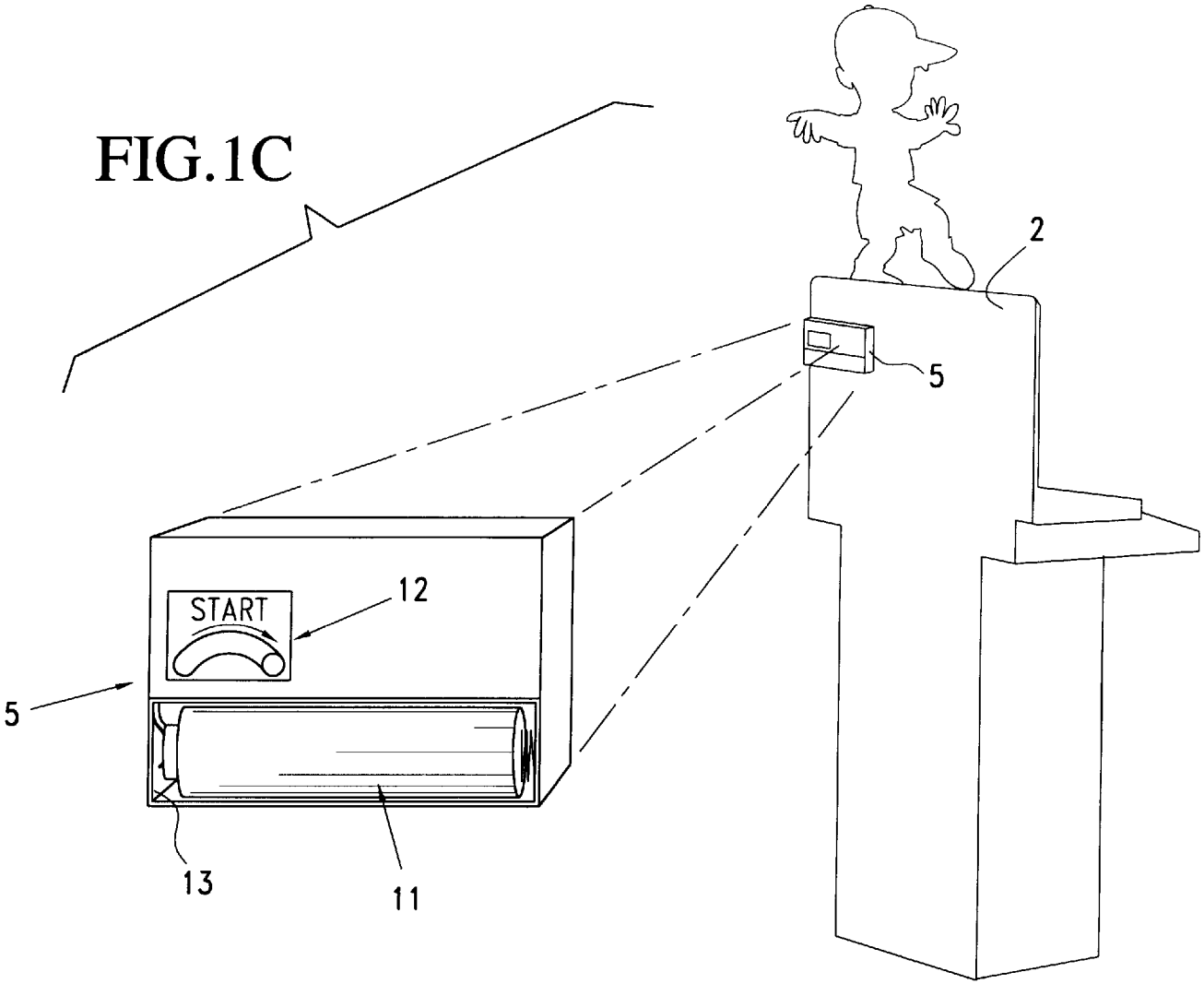
FIG. 1C shows a rear perspective view of the assembled rotating display.

FIGS. 1A, 1B and 1C illustrate a first embodiment of the invention. A point-of-purchase display 2 for merchandise 3 may be constructed of corrugated cardboard. In this embodiment, the merchandise may have the form of individual containers of products for sale, for example, plastic bottles containing health care products, or food products. The merchandise point-of-purchase display includes a rotating display 4 in the form of a rotating disk with printed material thereon. FIG. 1A illustrates how this rotating disk looks as it turns. The rotating disk 4 could also be shaped as a square or other polygon, or may include a hologram printed thereon or a small object attached thereto. FIG. 1B shows how the piezoelectric motor 5 is attached to the corrugated cardboard display 2 via two adhesive mounts 6, each adhesive mount having two external adhesive surfaces 8, 9. A hole is drilled, punched, or molded into the corrugated cardboard display 2 to allow the drive shaft 7 of the piezoelectric motor 5 to pass though the stationary part of the display 2. The two sets of adhesive mounts 6 are first mounted to the piezoelectric motor 2 at adhesive surface 8, then mounted to the stationary corrugated cardboard display 2 at adhesive surface 9. The plastic turntable 10 has adhesive to attach itself to the rotating part 4 of the display. The plastic turntable 10 is then placed over the drive shaft 7 and pushed in to secure. After a battery 11 is placed in the piezoelectric motor 5 housing, the start switch 12 may be switched on and the rotating part 4 of the display starts rotating in conjunction with the drive shaft.

Referring to FIG. 1C, the rotating display of FIG. 1A is shown in a back view. The back view includes an enlarged view of the piezoelectric motor 5 mounted to the back of the corrugated cardboard display 2 with the battery compartment 13 and battery therein, and start switch 12.

In this embodiment, the drive shaft 7 extending through the hole of the cardboard display is oriented horizontally, with the piezoelectric motor 5 attached to the rear of the display. As the rotating part 4 rotates, the stationary corrugated display serves as a background. The rotating part 4 itself may be fabricated from corrugated cardboard, plastic, etc., and may contain a printed hologram and/or printed advertising text relating to the displayed merchandise. The turntable 10 may be removably secured to drive shaft 7, for example, with a snap fit, friction fit, or threaded connection, so that the user may substitute different display attachments for the rotating display.

Figure 2A:
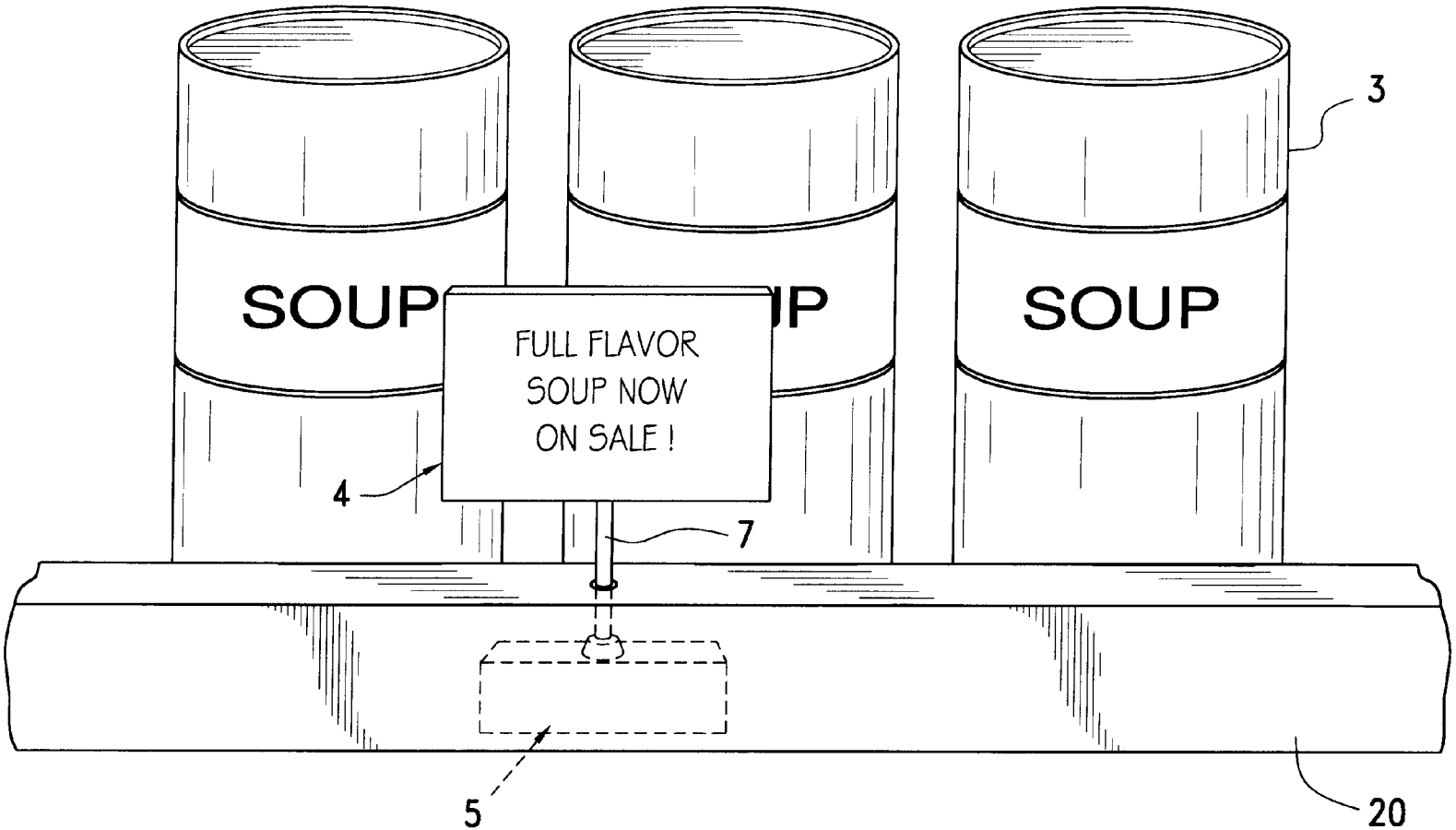
FIG. 2A shows a front view of an assembled rotating display used on a supermarket shelf display.
Figure 2B:
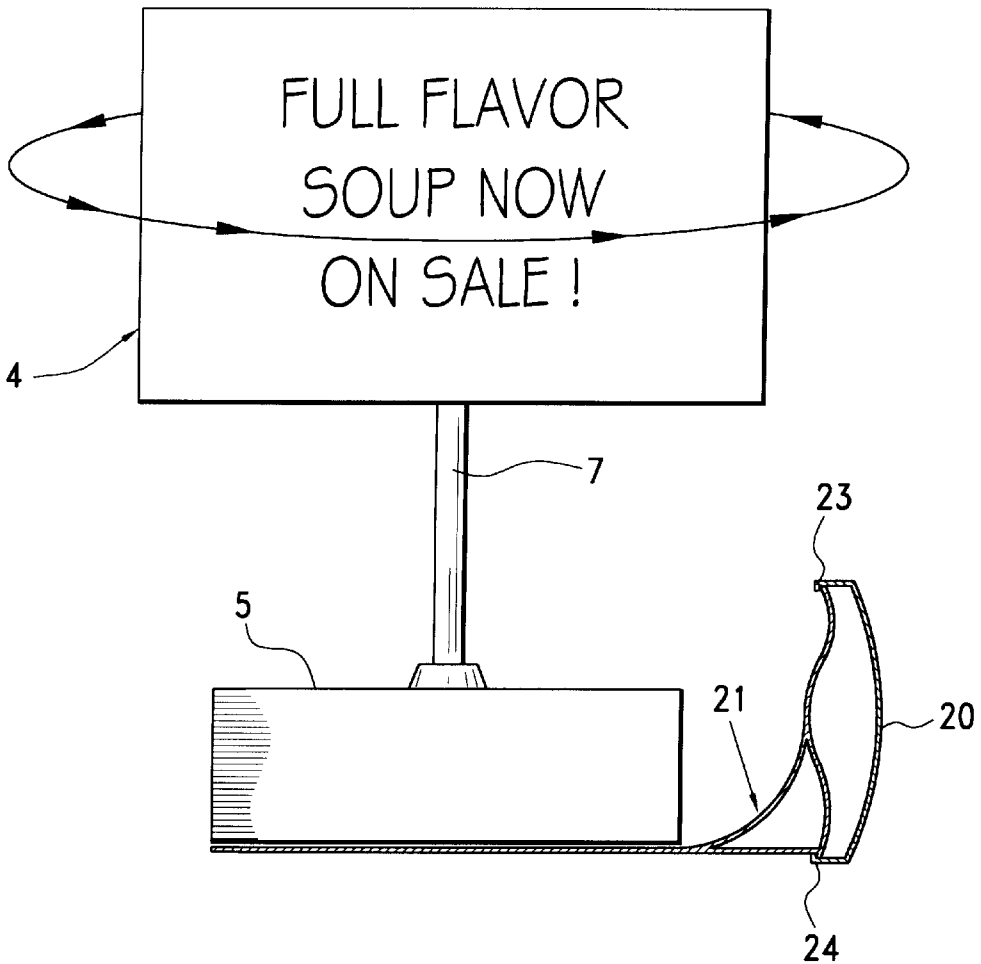
FIG. 2B shows a side view of the display of FIG. 2A.

FIGS. 2A, 2B, 2C and 2D illustrate other embodiments of this invention, having the form of a supermarket shelf display including a rotating display 4 with printed advertising material thereon. In these embodiments, the merchandise 3 has the form of soup cans or other grocery items. The front view of FIG. 2A shows the piezoelectric rotating display positioned on the shelf behind shelf price rail 20 as commonly used in supermarkets to mount prices of merchandise thereto along the edge of the shelf. The rotating display may be supported directly on the shelf, for example, on the shelf behind the shelf price rail 20, or as shown in the side view of FIG. 2B, the rotating display may be attached to the shelf price rail 20 via a plastic mount 21. The metal shelf price rail 20 has lips 23, 24 on the top and bottom that allow the plastic mount 21 to snap fit into the shelf rail. The plastic mount 21 serves to secure the rotating display 4 in a desired position on the shelf.

Figure 2D:
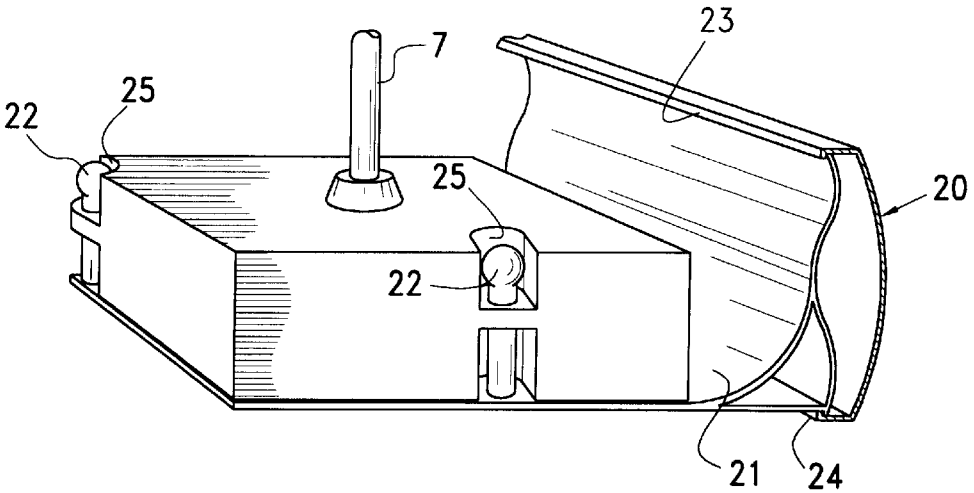
FIG. 2D shows an enlarged side perspective view of a rotating display for a supermarket shelf display.
Figure 2C:
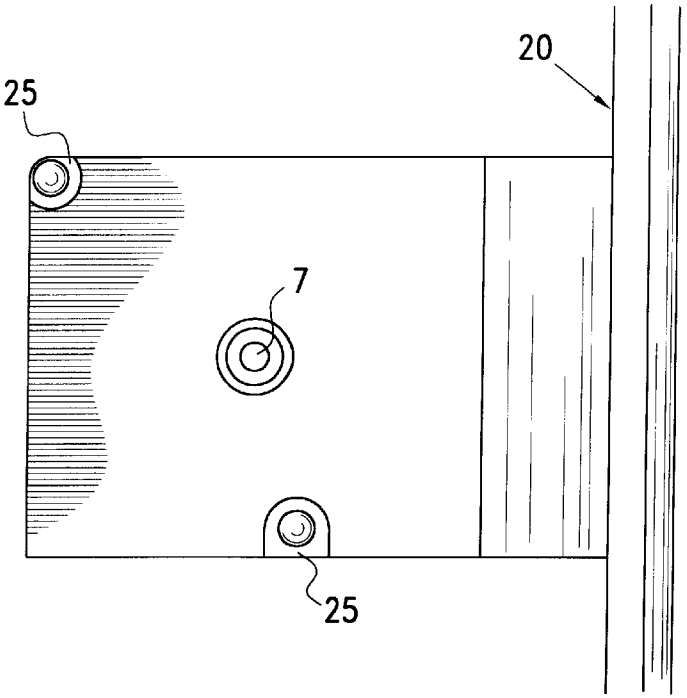
FIG. 2C shows a partial top view of the rotating display of FIG. 2A.

Referring to FIGS. 2C and 2D, there is shown that the piezoelectric motor 5 has two mounting holes or recesses 25 where corresponding plastic mount snap posts 22, integral with plastic mount 21, snap into place in the underside of the piezoelectric motor 2. The top view shows the position of these motor mounting holes 25. The partial side perspective view shows the motor 5 with the plastic motor mount 21, and that the motor 5 is mounted to the plastic motor mount 21 via the snap posts 22, and its position relative to the metal price rail 20.

Figure 3B:
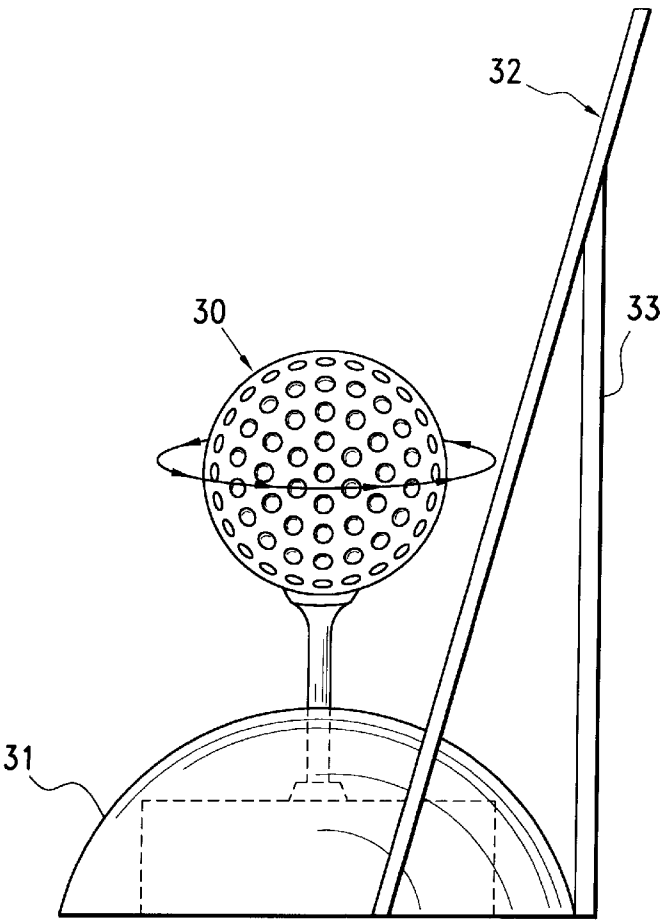
FIG. 3B shows a side view of the merchandise display of FIG. 3A.
Figure 3A:
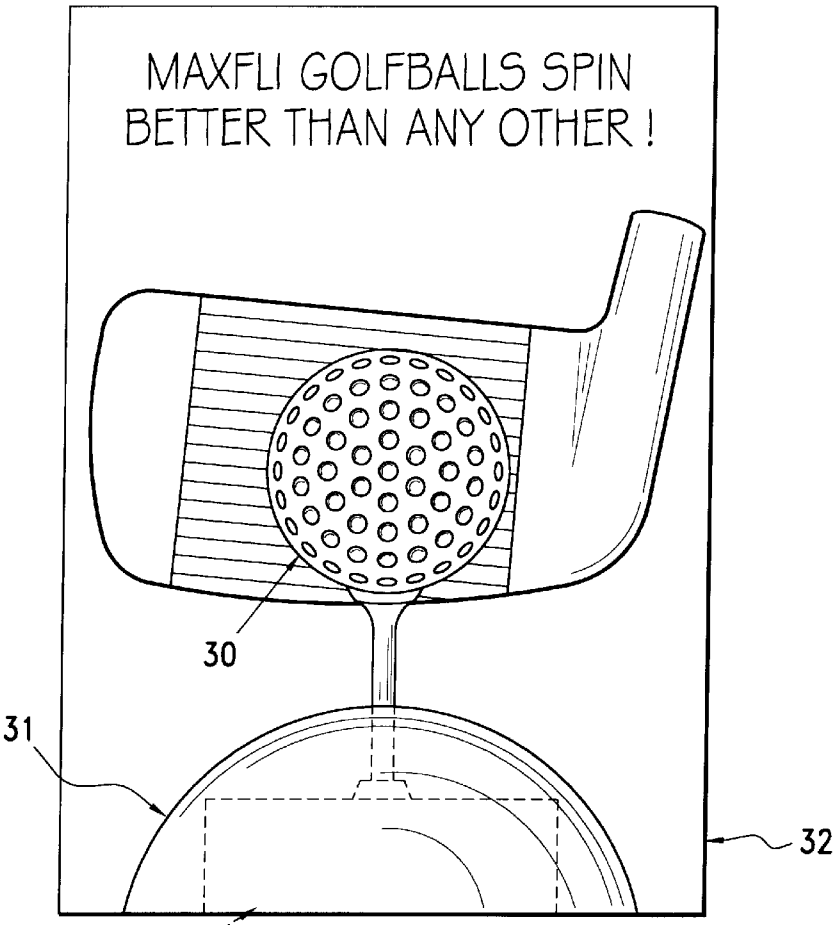
FIG. 3A shows a front view of an assembled rotating display used in a golf ball merchandise display.
Figure 3C:
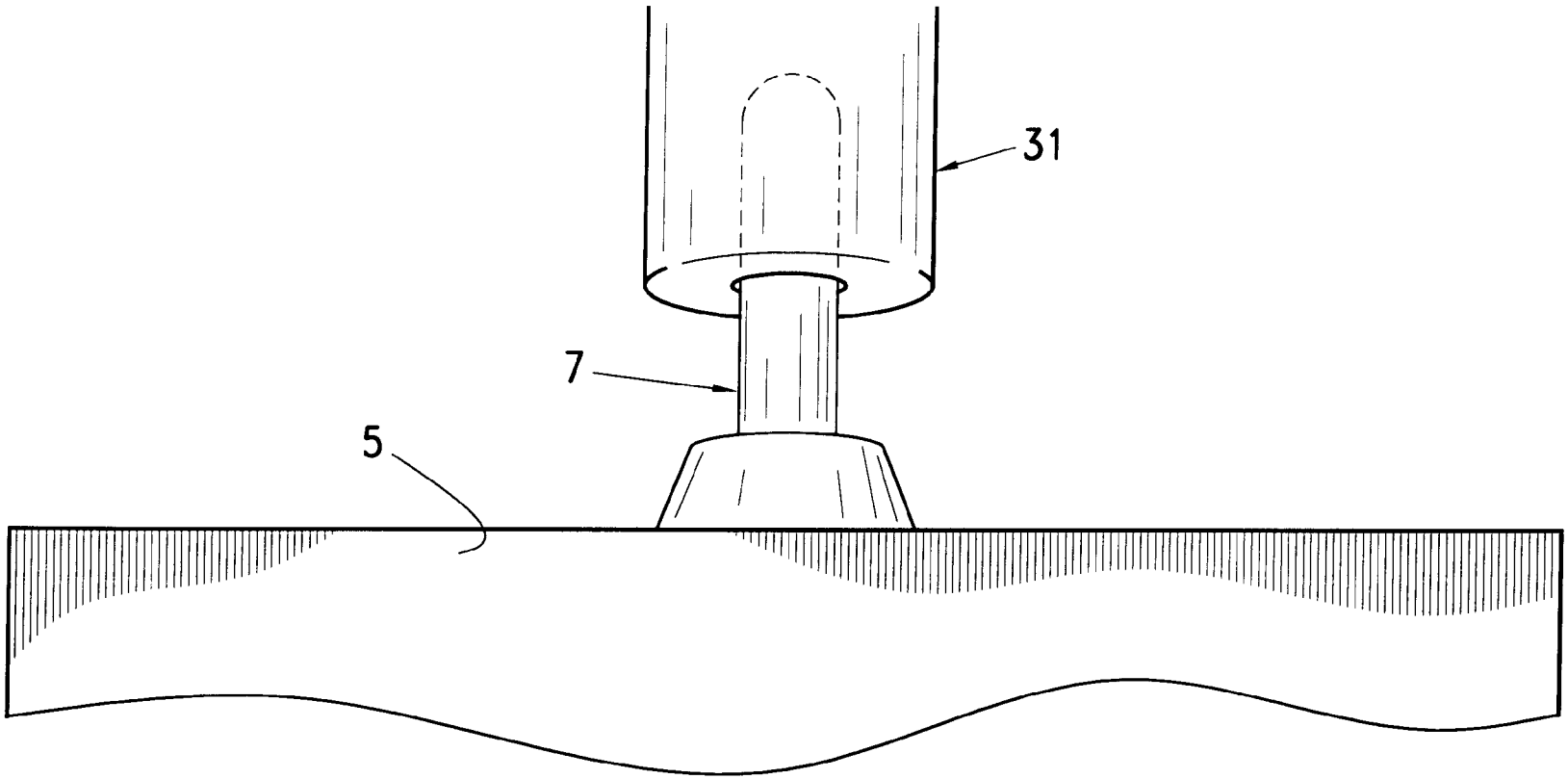
FIG. 3C shows a partial, enlarged perspective view of the display of FIG. 3A.

FIGS. 3A, 3B and 3C illustrate another embodiment, where the point-of-purchase merchandise display includes a rotating display for a golf ball. In this embodiment, the merchandise has the form of golf balls, or alternately, the display may be used to advertising a brand of golf clubs. The front view of FIG. 3A shows a golf ball 30 rotating on a piezoelectric motor 5. A motor cover 31 may be placed on the piezoelectric motor 5 to conceal the motor from view, the motor being supported on a display surface. Next a golf tee-shaped support 35 is mounted on the motor drive shaft 7 with the golf ball 30 mounted or supported on the golf tee support 35. The golf tee support 35 extends through a hole in cover 31, and cover 31 may be colored green to simulate a golf course green. A cardboard display 32 is used as a background with a picture of a golf club and a caption with advertising media for the merchandise. The cardboard display 32 may be cut to fit over the motor cover 31, and then adhered to the motor cover 31, for example, with glue. FIG. 3B illustrates. how the cardboard display 32 may be angled with respect to a cardboard support 32, whereby the golf ball 30 is free to rotate with the tee support 35 and drive shaft 7 and the cardboard support 32 acts as a backdrop for the golf ball 30 being rotatably displayed. FIG. 3C illustrates an enlarged view of the golf tee support 35 drilled out at the bottom to accept the drive shaft 7 of the motor 5, such that the shaft of the tee support has the form of a sleeve in which the drive shaft is received.

Figure 4A:
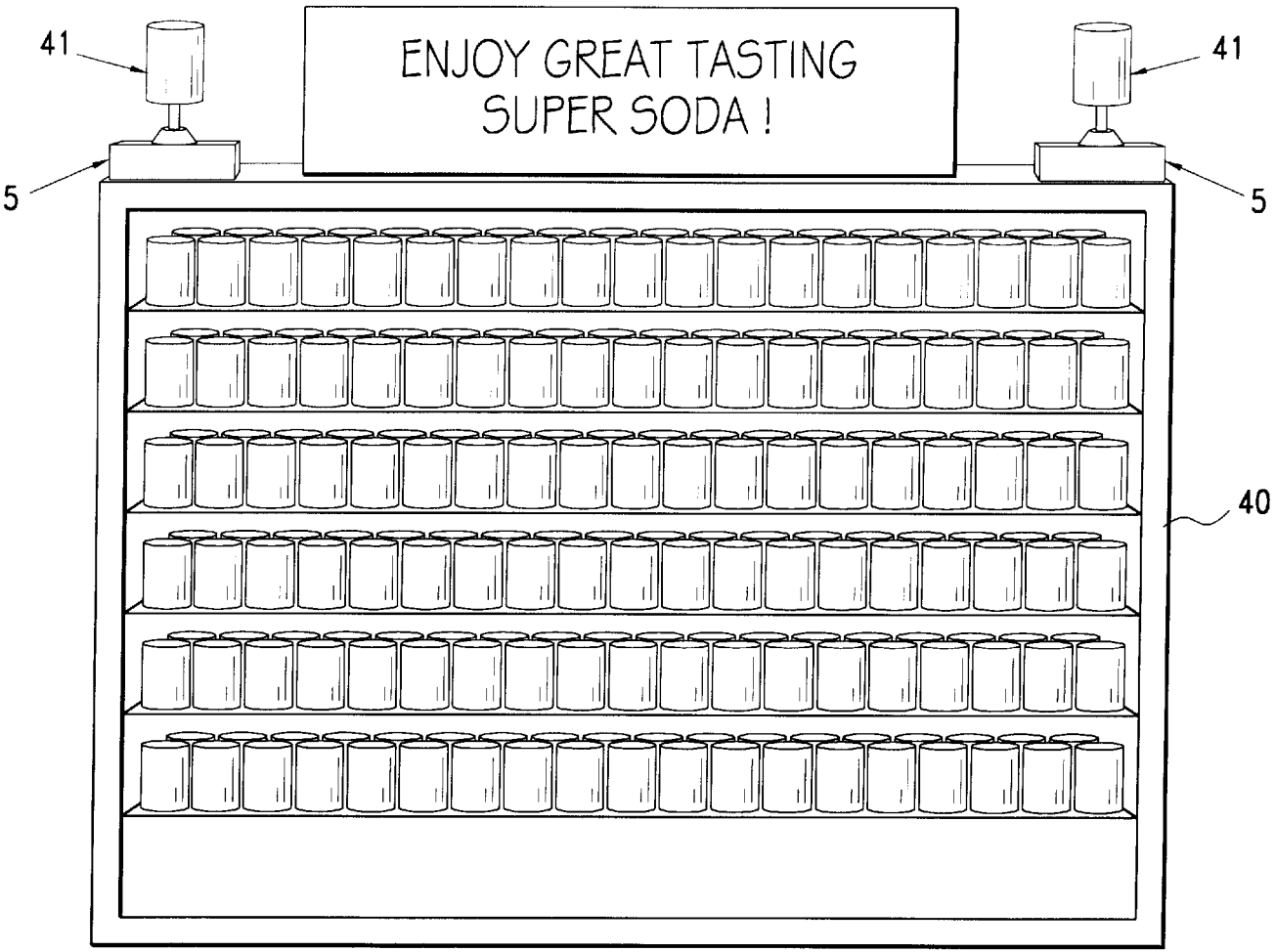
FIG. 4A shows a front view of an assembled rotating display used in a beverage merchandise display.
Figure 4B:
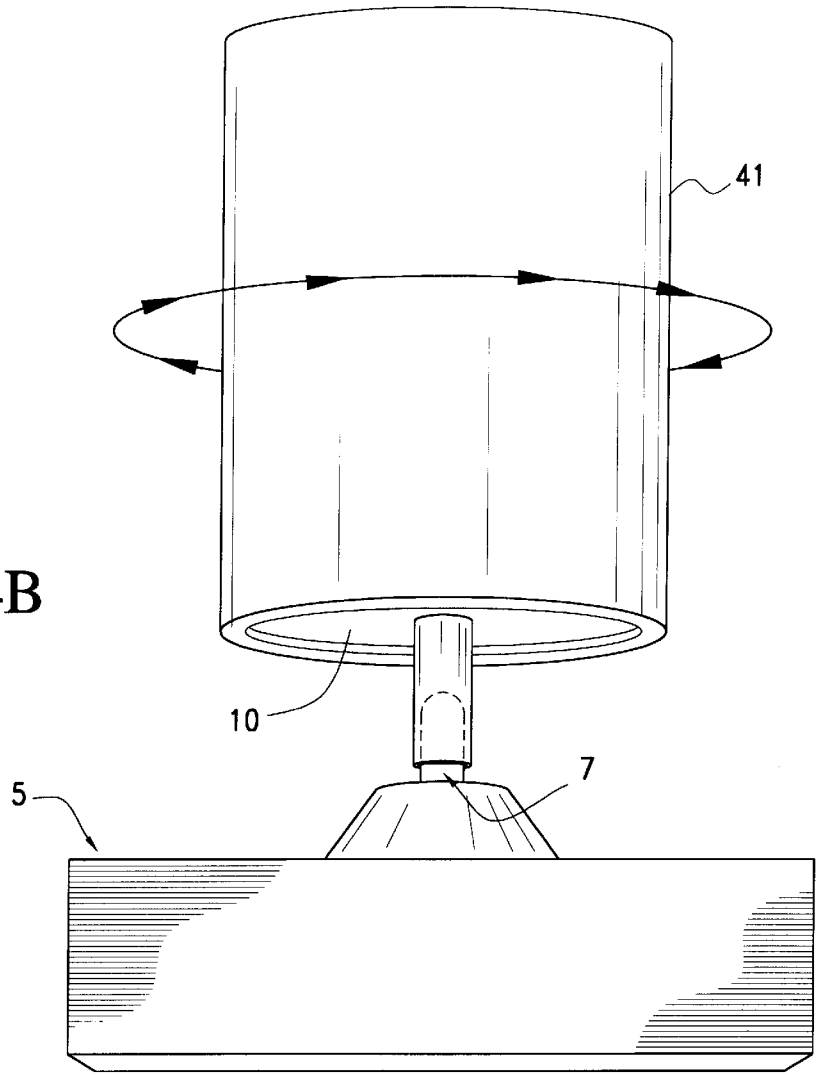
FIG. 4B shows an enlarged perceptive view of the rotating display in FIG. 4A.

FIGS. 4A and 4B illustrate another embodiment, in the form of a rotating beverage display for the point-of-purchase display of beverages. A large soda display 40 is shown where the merchandise 3, in the form of beverage cans, is displayed for purchase. Empty soda cans 41 (or replicas of the soda cans displayed for purchase) are mounted on piezoelectric motors 5 rotating at the top of the display. Referring to FIG. 4B, an empty (or replica) soda can 41 is mounted to a plastic turntable 10, for example, with adhesive. The bottom portion of plastic turntable 10 has the form of a sleeve that is placed snugly on to the drive shaft 7 of the motor 5 in a manner that the can 41 rotates in conjunction with the drive shaft.

Figure 5A:
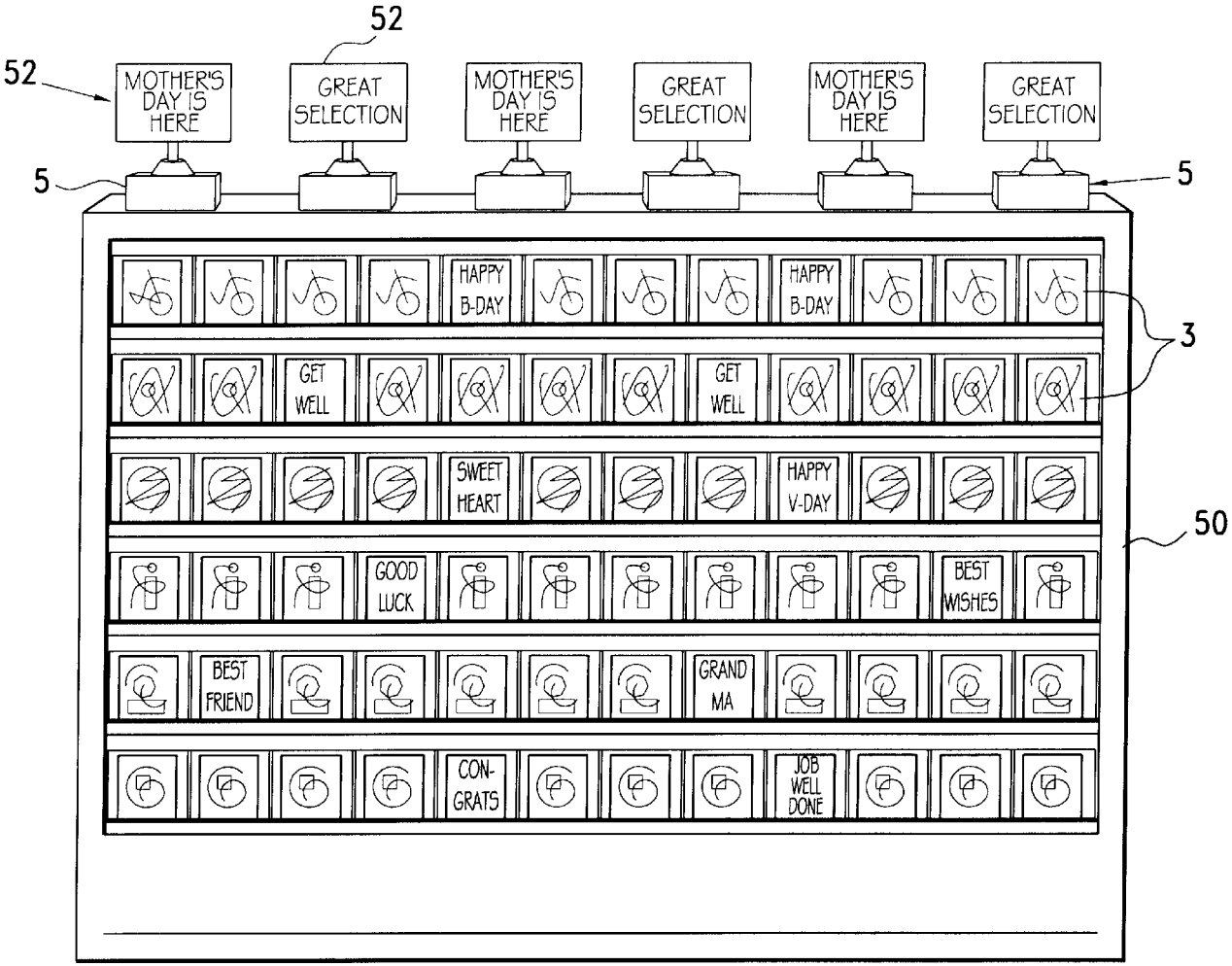
FIG. 5A shows a front view of an assembled rotating display used in a greeting card merchandise display.
Figure 5B:
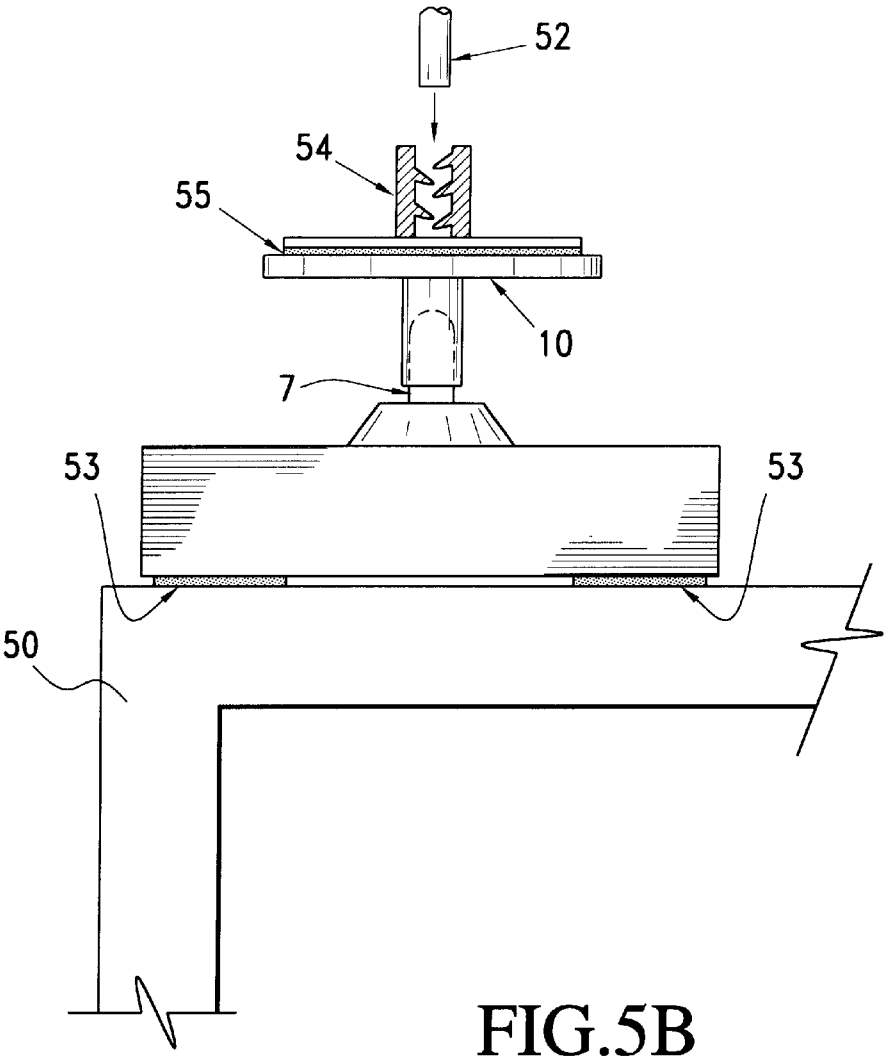
FIG. 5B shows an enlarged partial side view of the rotating display in FIG. 5A.

FIGS. 5A and 5B illustrate a greeting card display 50 including several rotating displays. Several piezoelectric motors 5 are mounted on the top of a large greeting card display 50 for the point-of-purchase display of merchandise 3 in the form of greeting cards. Rotating signs 52 are placed on the piezoelectric motors 2 displaying various advertising slogans. Referring to FIG. 5B, one of the piezoelectric motors 5 is mounted to the corner of the greeting card display 50, for example, via adhesive mounts 53. A sign holder 54 is mounted to the top of a plastic turntable 10, for example, by an adhesive mount 55. The plastic turntable 10 is then placed over the drive shaft 7 of the motor 5. The sign 52 is inserted into the sign holder 54 by pushing down into holding teeth 58 that removably secure the sign. The sign holder 54 itself may be of a conventional design used in stationary displays. The use of the plastic turntable 10, with the adhesive mount, allows this display to use such standard sign holders. As illustrated in FIG. 5A, the signs 52 include text advertising the card merchandise and promoting several cards. Alternately, greeting cards themselves may be used as signs 52.

Figure 6B:
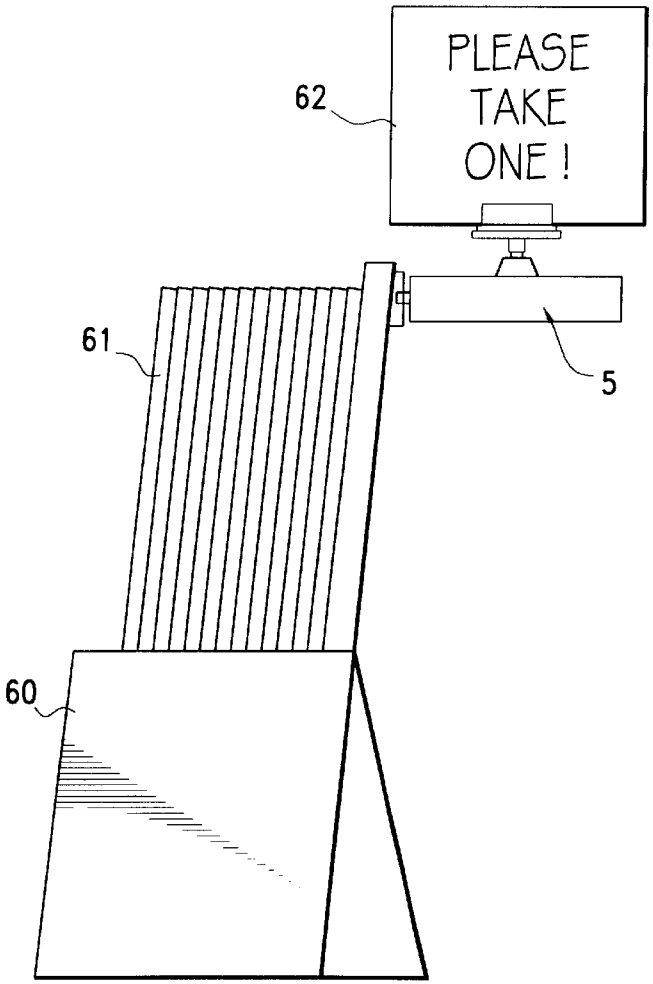
FIG. 6B shows a side view of the brochure holder display of FIG. 6A.
Figure 6A:
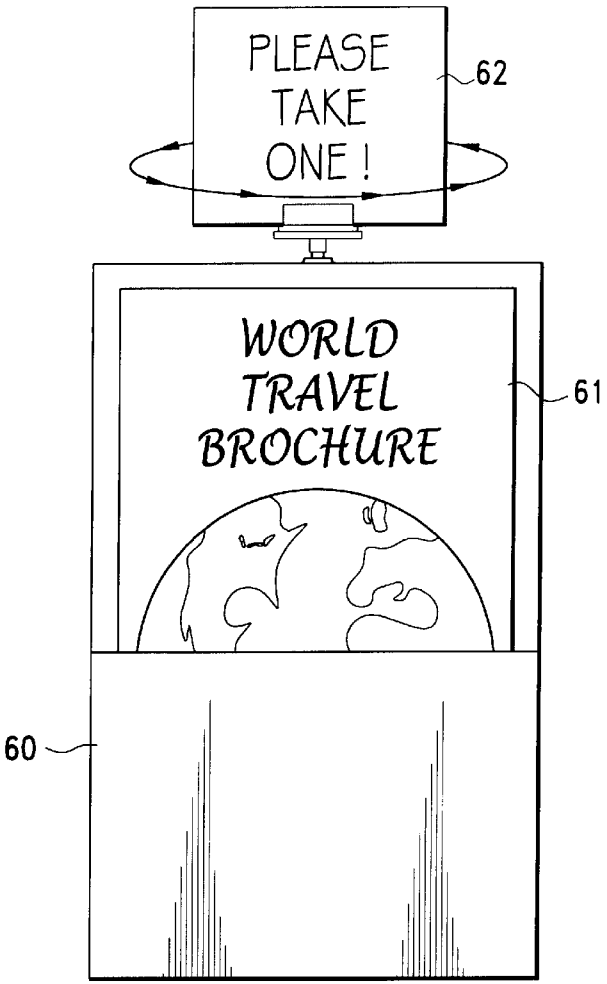
FIG. 6A shows a front view of an assembled rotating display used in a brochure holder display.
Figure 6D:
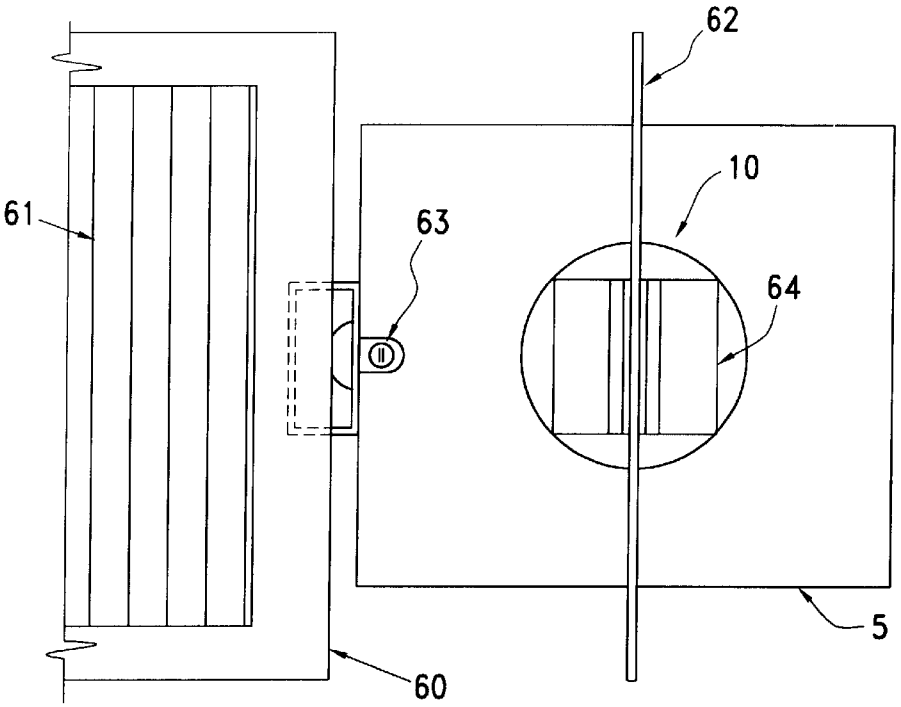
FIG. 6D is a top plan view of rotating display of FIG. 6A.
Figure 6C:
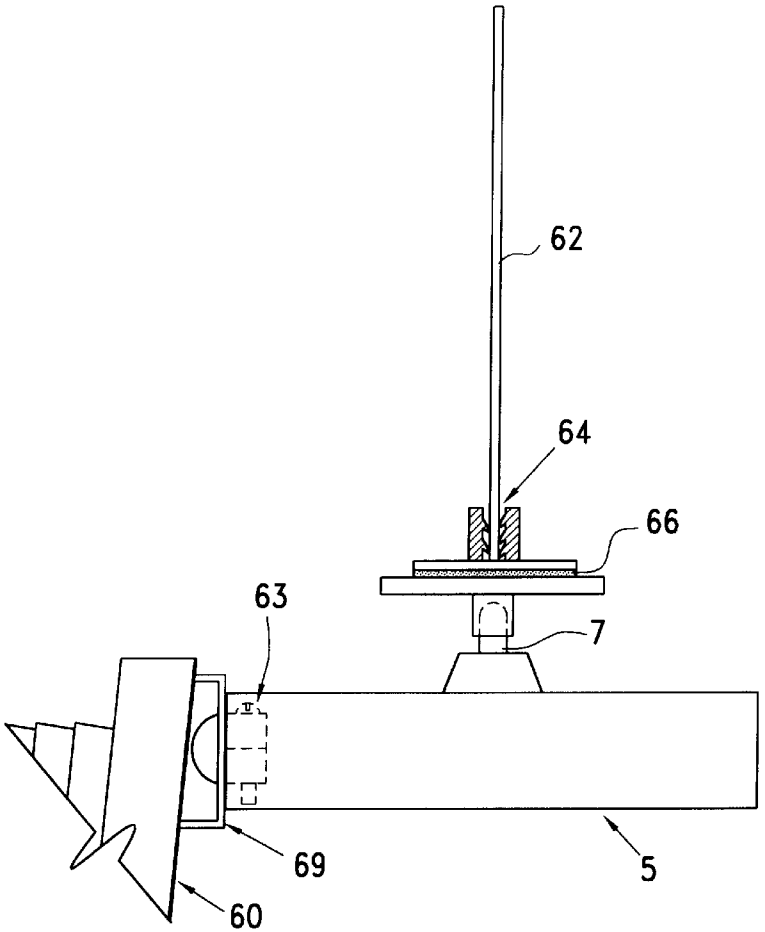
FIG. 6C shows an enlarged partial side view of the rotating display in FIG. 6A.

FIGS. 6A and 6B illustrate another embodiment, in the form of a rotating display for a brochure holder. The front view of FIG. 6A shows a brochure holder 60 holding stacked brochures 61. Mounted on the top rear of the brochure holder 60 is a piezoelectric motor 5 with a rotating display sign 62. The enlarged partial side and top views of FIGS. 6C and 6D illustrate an attachment of the motor 5 to the brochure holder 60 in more detail. The motor 5 is attached to the top part of the plastic brochure holder display 60 via a bolt and nut assembly 63. As seen in FIG. 6C, the display 60 includes a rear mounting bracket 69 that may be integrally formed with the remainder of the display. The rotating sign 62 is held in place by holding teeth 64 in a sign holder 65 mounted to a plastic turntable 10, for example, sign holder 65 may be mounted to turntable 10 via an adhesive mount 66. The plastic turntable 10 is attached to the drive shaft 7 of the motor 5. The top view of FIG. 6 shows the motor 5 attached to mounting bracket 69 through the nut and bolt assembly 63.

Figure 7A:
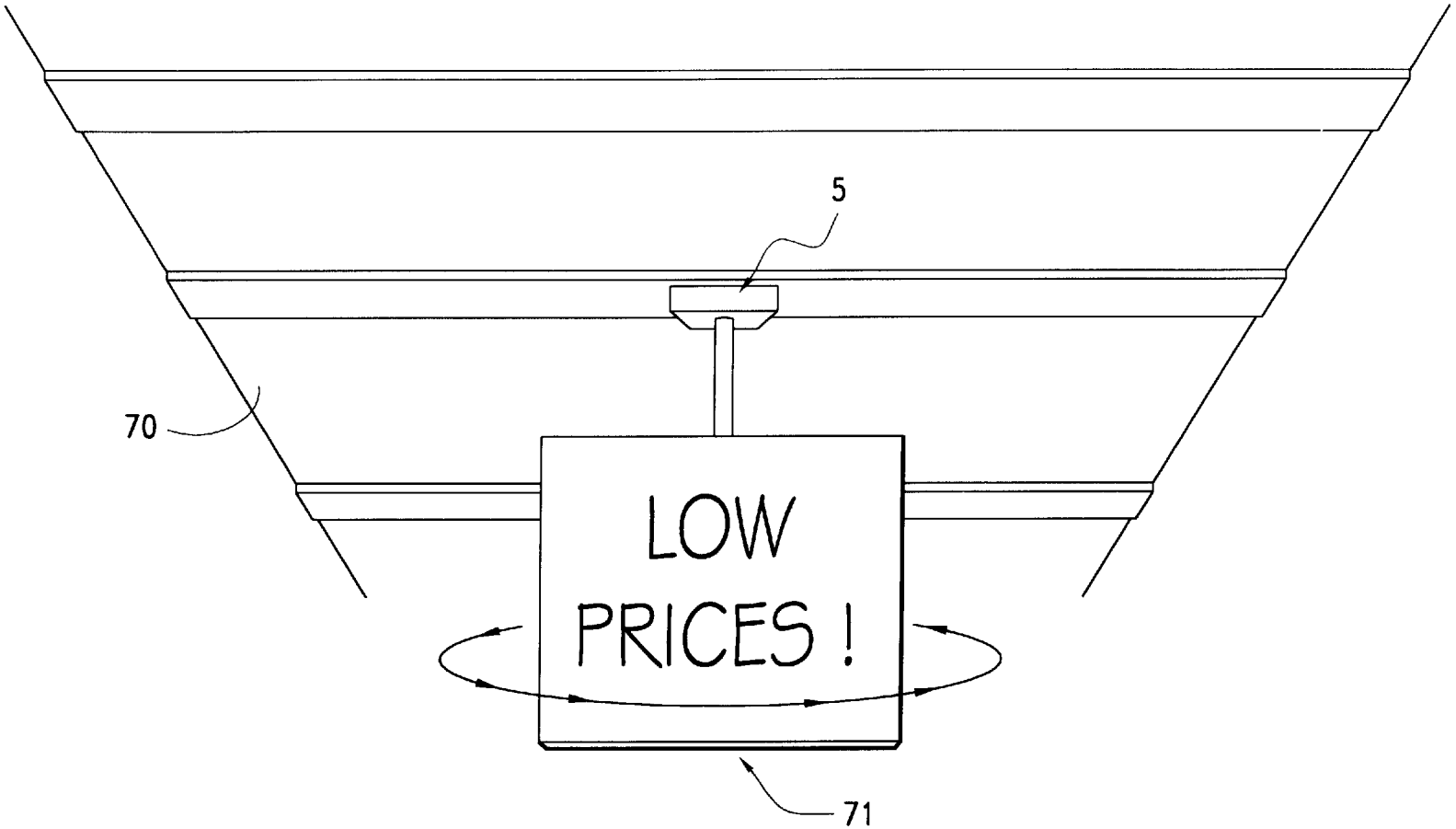
FIG. 7A shows a front perspective view of an assembled rotating display used in a ceiling display.
Figure 7B:
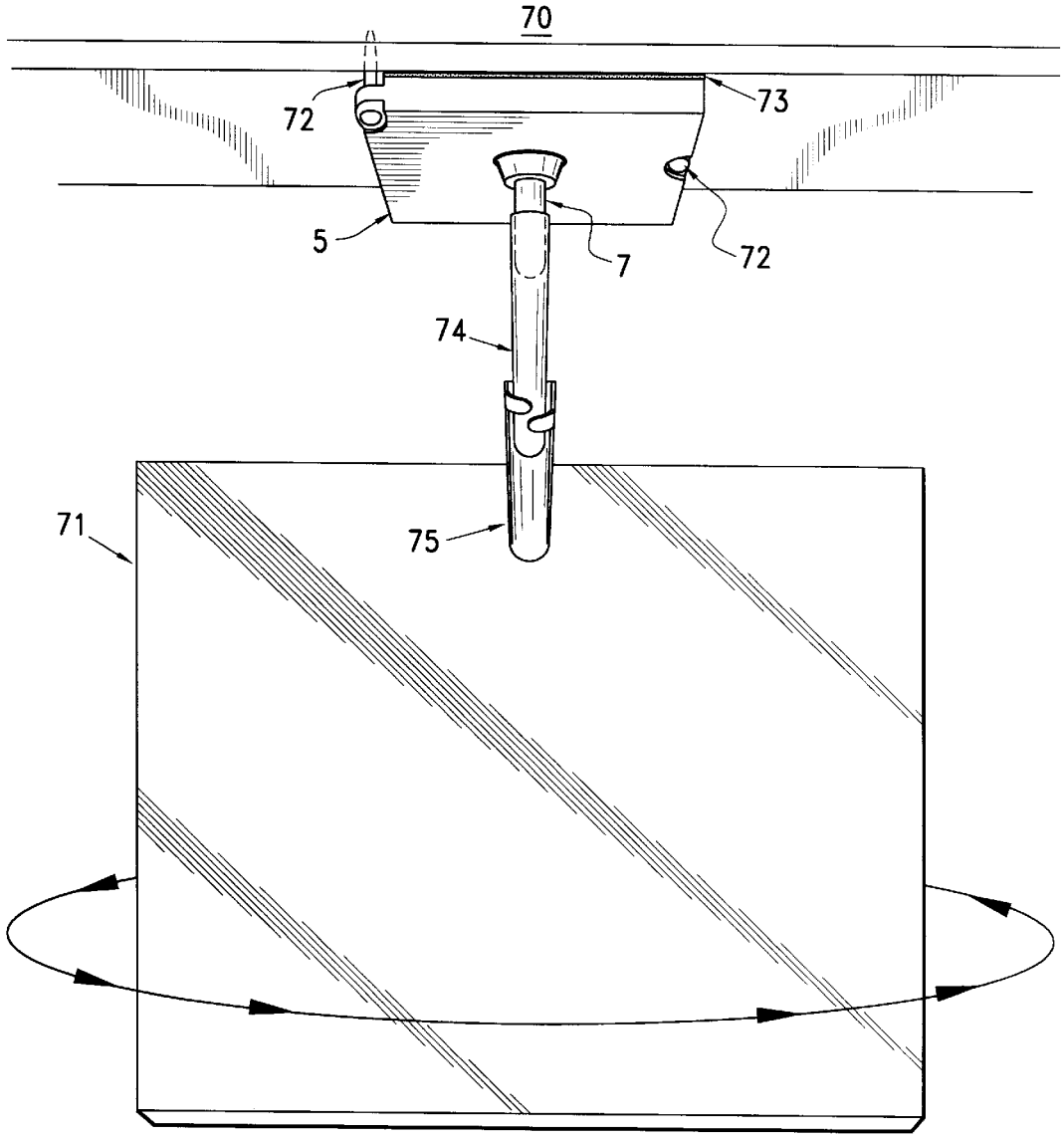
FIG. 7B shows a partial enlarged view of the ceiling display of FIG. 7A.

FIGS. 7A and 7B illustrate another embodiment, where the display has the form of a rotating display mounted to a ceiling. Referring to FIG. 7A, a piezoelectric motor 5 is shown attached to the ceiling 70 in an inverted position, i.e., the drive shaft 7 extends downward from the motor. A rotating sign 71 with advertising text is suspended from the motor 5. Referring to FIG. 7B, the piezoelectric motor 5 is mounted to the ceiling via screw mounts 72 and/or adhesive mount 73. A small sign 71 is attached to a plastic extension rod 74 via an alligator clip 75. The plastic extension rod 74 is then attached to the drive shaft 7 of the motor.

Figure 8A:
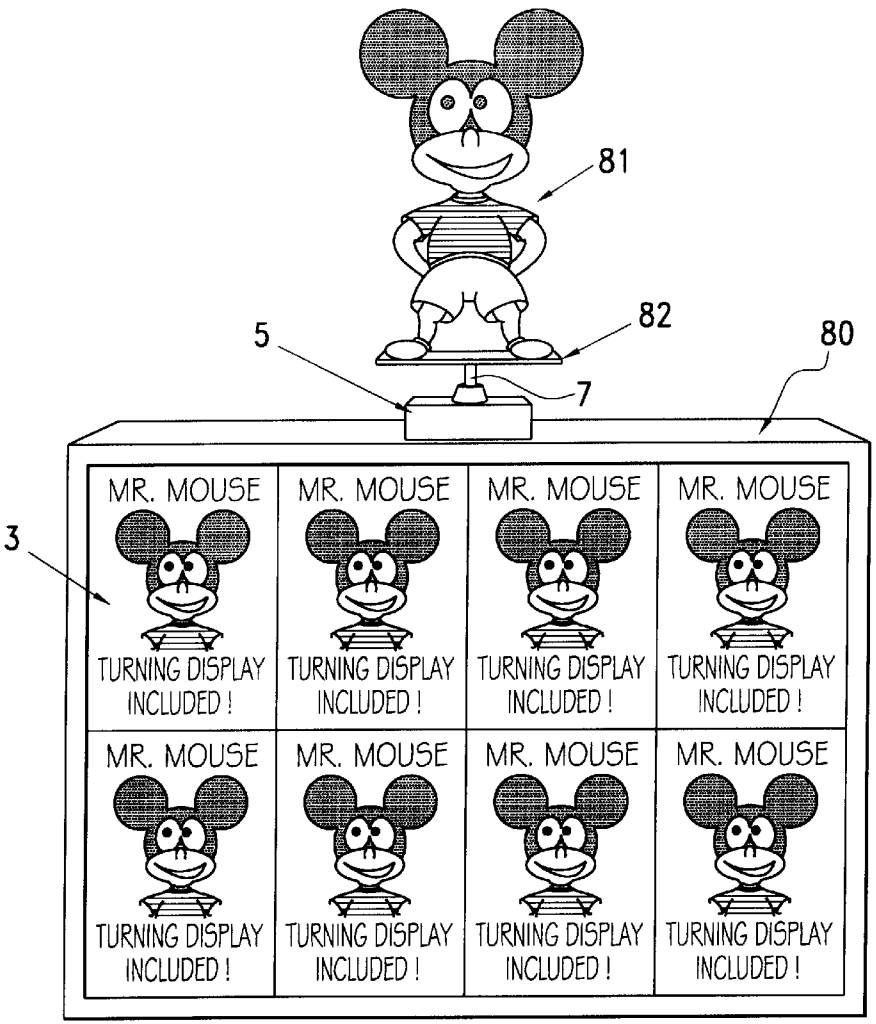
FIG. 8A shows a front view of an assembled rotating display used in a figurine merchandise display.
Figure 8B:
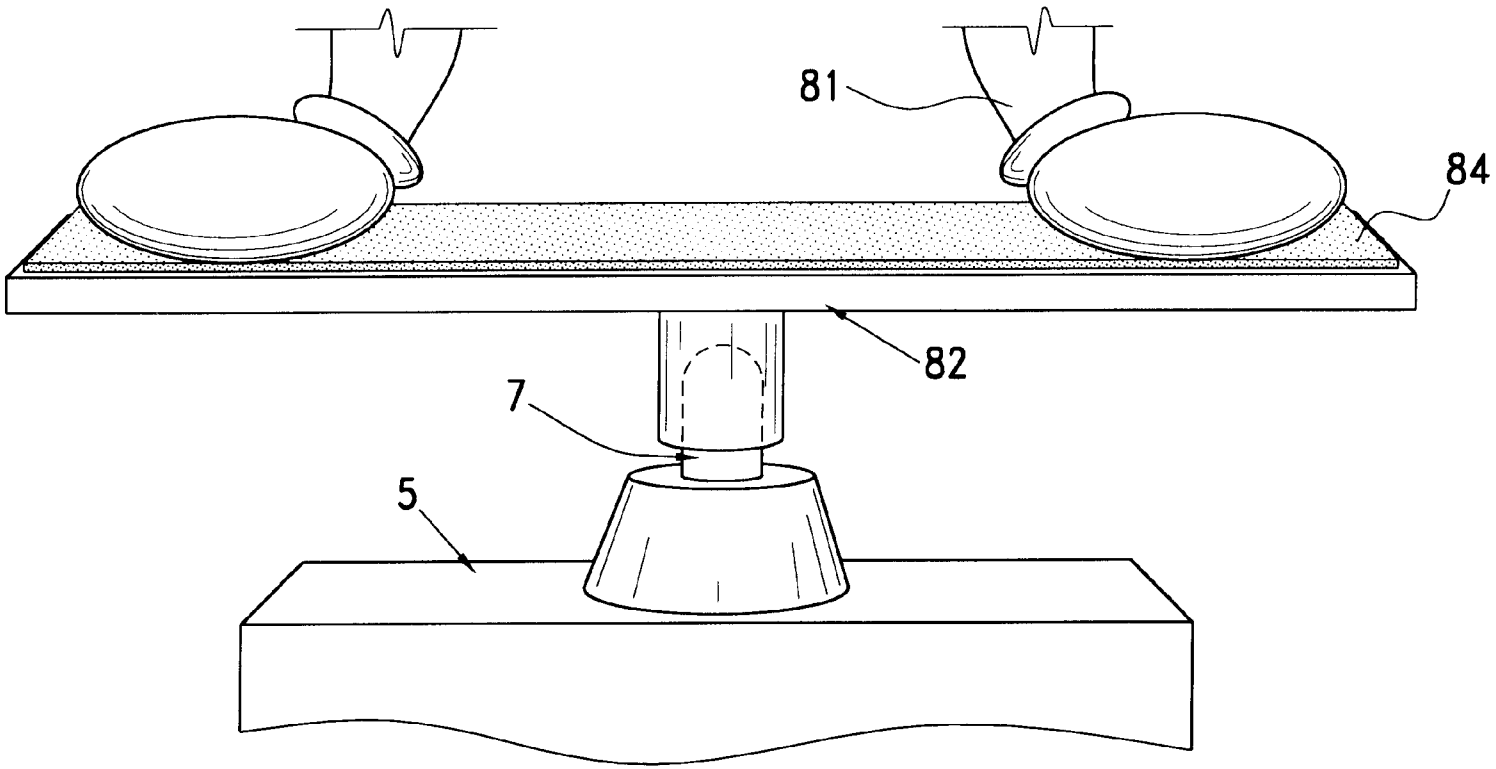
FIG. 8B shows an enlarged partial front view of the display of FIG. 8A.

FIGS. 8A and 8B illustrate another embodiment, where the display has the form of a point-of-purchase display for figurines and includes a rotating display. Referring to FIG. 8A, a piezoelectric motor 5 is shown attached to the top of a toy display 80 where merchandise 3 in the form of toy figurines is displayed for sale. A figurine 81 is mounted to a turntable support 82. The turntable 82 is attached to the drive shaft 7 of the piezoelectric motor 5. As seen in the partial enlarged view of FIG. 8B, the bottom part of a figurine 81 is mounted to the turntable 82 via a two-sided adhesive mount 84. The turntable 82 is attached to the drive shaft 7 of the piezoelectric motor 2.

Figure 9B:
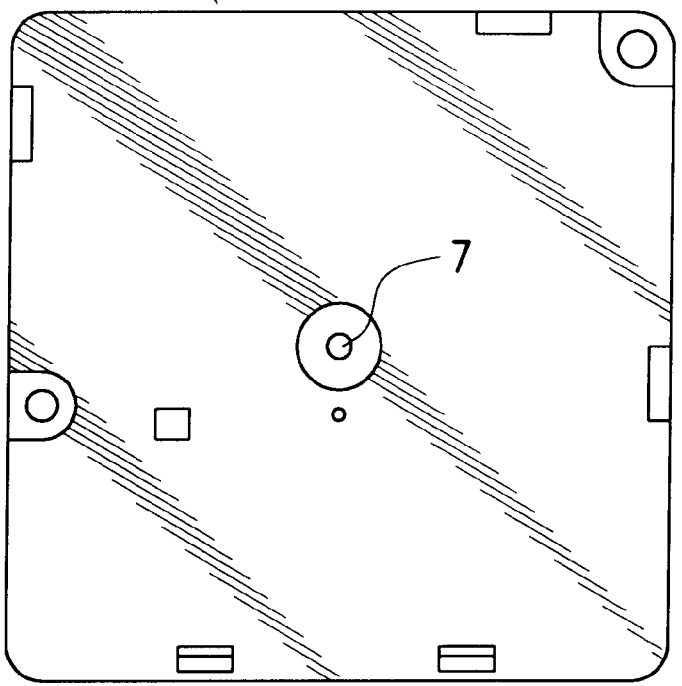
FIGS. 9A and 9B show side and top views of a piezoelectric motor, including specifications thereof.
Figure 9A:
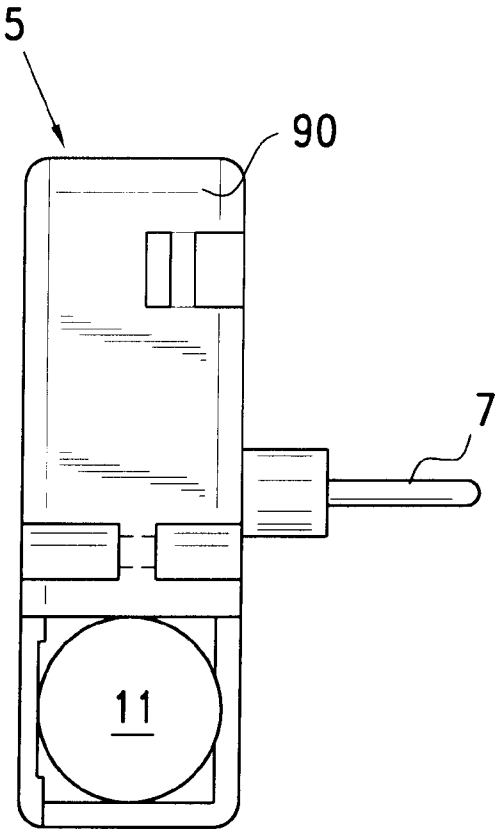

FIGS. 9A and 9B illustrate a suitable transistor oscillator motor 5 for various embodiments of this invention. The transistor oscillator motor 5 preferably includes a transistor oscillator designed for rotary movement. Such motors have been used to drive the pendulum of anniversary clocks, and may be a transistor oscillator available as Model DR-2200 Shontek from Duteck Industrial Co. Such transistor oscillator motor has a housing 90 with overall dimensions of about 58×58×16 mm, and accommodates one AA-size battery. The battery may typically have a life of up to one year under non-stop use, although battery life will be dependent on the weight of the display being rotated. The driving system for the illustrative embodiment includes a start switch, as seen in FIG. 1C for example, that is, the motor begins and continues operation whenever a battery is inserted and the start switch is turned on until the switch is turned off. This motor has an amplitude of 360 degrees with two-way reversible revolution, and a torque for shaft within 25 g.

For lighter objects that are being rotated, a suitable crystal quartz oscillator designed for standard wall clocks is a 32.768 kHz crystal quartz oscillator available from Seiko Corporation. The driving system of this device is self-start, that is, it begins and continues operation whenever a battery is inserted, and is accommodated by a AA-size battery.

If heavier items are being displayed, a larger motor may be necessary. Larger crystal quartz oscillators are available which are otherwise used for rotating larger sized clock hands. Of course, if heavier items are being displayed, a piezoelectric motor with larger capacity may be necessary.

Optionally, the motor may be provided with a light sensitive switch, such that the rotating portion of the display rotates only in the presence of light. If a retail store is closed with lights off 12 hours a day, then the battery life of the battery in the motor would double, as from one year to two years. Although the lifespan of the battery is expanded, the cost of including a light sensitive switch is almost the same as the cost of a battery. Thus, this alternative embodiment is designed for the retailer who intends to use a large quantity of display devices over a long period of time, which would justify the initial increased cost. Another situation which may advantageously employ the light sensitive switch is when the display device is used in a store which has night security with motion detectors which might set off an alarm in response to the movement of a turning display.

The embodiments of the present invention described above are to be regarded in all respects as merely illustrative and not restrictive. Accordingly, the present invention may be embodied in other specific forms without deviating from the spirits thereof. For example, the rotating display device could be used to display baseball cards, small advertising signs, photographs, holographic pictures, silverware, rare coins, shells, toys, computer chips, uncut stones, ball point pens, golf balls, fishing lures, etc. with holders designed to securely, and preferably removably, hold the item to the device for rotation. Such displays could be used in specialty shops, trade shows, museums, department stores, supermarkets, and even the home. The present invention is therefore to be limited only by the scope of the following appended claims.

What is claimed is:

1. A merchandise display comprising a rotating display device, wherein the rotating display device comprises:

a piezoelectric motor;

a photosensitive switch connected to the piezoelectric motor;

a drive train connected to the piezoelectric motor and extending to an exterior of the motor; and a holder connected to the drive train and adapted to securely hold a sign or merchandise item, wherein the holder rotates in conjunction with the drive train.

2. The display device of claim 1, wherein the piezoelectric motor includes quartz movement.

3. The display device of claim 2, wherein the piezoelectric motor is powered by a battery.

4. The display device of claim 1, wherein tee piezoelectric motor and the drive train generates a continuous movement of the portion of the drive train exterior to the motor.

5. The display device of claim 1, wherein the holder is removably attached to the drive train.

6. The display device of claim 1, wherein the merchandise display includes multiple items of merchandise.

7. The display device of claim 1, wherein the piezoelectric motor is adhered to a rear side of a section of the merchandise display, the drive train extending through an aperture in said merchandise display section, and the holder is attached to the drive train and located on an opposed, front side of said merchandise display section.

8. The display device of claim 7, wherein the motor is adhered to the rear side of the section of the merchandise display with an adhesive.

9. The display device of claim 1, wherein the holder includes a shaft with a central aperture into which a drive shaft of the motor is received.

10. The display device of claim 1, further comprising a merchandise identifying sign secured to the holder with an adhesive.

11. The display device of claim 1, wherein the holder is adapted to securely hold an advertising sign with textual information advertising merchandise displayed on the merchandise display.

12. A method of rotatably displaying a sign or merchandise item, comprising:

attaching a sign or merchandise item to a holder, and attaching the holder to a drive train of a piezoelectric motor, the piezoelectric motor connected to a photosensitive switch; and selectively coupling a power source to the piezoelectric motor in response to the photosensitive switch, whereby the drive train, holder and sign or merchandise item are rotatably displayed.

13. The method of claim 12, further comprising attaching the piezoelectric motor to a point-of-purchase display where merchandise items are displayed.

* * * * *

UNITED STATES PATENT AND TRADEMARK OFFICE

CERTIFICATE OF CORRECTION

PATENT NO. : 6,502,338 B1
DATED : January 7, 2003
INVENTOR(S) : Marshall, Roger S.

It is certified that error appears in the above-identified patent and that said Letters Patent is hereby corrected as shown below:

Title page,
Item [76], Inventor information reading "4922 Comish Heights", should read as -- 4922 Cornish Heights Parkway --.
Item [60], Provisional application information reading "Apr. 4, 1998", should read as -- Aug. 4, 1998 --.

Column 10,
Line 1, reading "tee", should read as -- the --.

Signed and Sealed this

Twelfth Day of August, 2003

JAMES E. ROGAN
*Director of the United States Patent and Trademark Office*